US006637384B1

(12) United States Patent
Mendler

(10) Patent No.: US 6,637,384 B1
(45) Date of Patent: Oct. 28, 2003

(54) RIGID CRANKSHAFT CRADLE AND ACTUATOR

(76) Inventor: Edward Charles Mendler, 7 Millside La., Mill Valley, CA (US) 94941

( * ) Notice: Subject to any disclaimer, the term of this patent is extended or adjusted under 35 U.S.C. 154(b) by 469 days.

(21) Appl. No.: 10/110,416

(22) PCT Filed: Nov. 3, 2000

(86) PCT No.: PCT/US00/41813

§ 371 (c)(1),
(2), (4) Date: Apr. 10, 2002

(87) PCT Pub. No.: WO01/36798

PCT Pub. Date: May 25, 2001

(65) Prior Publication Data

(65)

Related U.S. Application Data

(60) Provisional application No. 60/164,774, filed on Nov. 12, 1999.

(51) Int. Cl.[7] ..... F02B 75/06

(52) U.S. Cl. ..... 123/48 B; 123/197.4; 123/78 F

(58) Field of Search ..... 123/48 B, 78 F, 123/197.4

(56) References Cited

U.S. PATENT DOCUMENTS

| | | | |
|---|---|---|---|
| 741,179 | A | 10/1903 | Sproehnle |
| 887,633 | A | 5/1908 | Heginbottom |
| 936,409 | A | 10/1909 | Chapman |
| 1,160,940 | A | 11/1915 | Momo |
| 1,715,368 | A | 6/1929 | Jaussaud |
| 1,872,856 | A | 8/1932 | Walker |
| 2,357,031 | A | 8/1944 | Stabler |
| 2,433,639 | A | 12/1947 | Woodruff et al. |
| 2,589,958 | A | 3/1952 | Petit |
| 2,770,224 | A | 11/1956 | Ericson |
| 3,633,552 | A | 1/1972 | Huber |
| 4,195,613 | A | 4/1980 | Bratt et al. |
| 4,738,230 | A | 4/1988 | Johnson |
| 4,860,702 | A | 8/1989 | Doundoulakis |
| 5,215,051 | A | 6/1993 | Smith |
| 5,572,959 | A | 11/1996 | Hedelin |
| 5,605,120 | A | 2/1997 | Hedelin |
| 5,611,301 | A | 3/1997 | Gillbrand et al. |

FOREIGN PATENT DOCUMENTS

| | | |
|---|---|---|
| DE | 3127760 | 3/1983 |
| DE | 3644721 A1 | 7/1988 |
| EP | 0 345 366 A1 | 12/1989 |
| EP | 0 426 540 A1 | 10/1990 |
| EP | 0 560 701 A1 | 2/1993 |
| FR | 440.863 | 3/1912 |
| GB | 20326 | 9/1906 |
| GB | 13152 | 6/1907 |
| JP | 55 64131 | 5/1980 |
| WO | WO 92/09799 | 6/1992 |
| WO | WO 97/36096 | 10/1997 |

OTHER PUBLICATIONS

U.S. 5,542,387 A (Okubo) Aug. 6, 1996, Fig. 2.
U.S. 5,564,379 A (Westphal) Oct. 15, 1996, Fig. 1.

(List continued on next page.)

*Primary Examiner*—Henry C. Yuen
*Assistant Examiner*—Douglas A. Salser

(57) ABSTRACT

Crankshaft main bearing failure in variable compression ratio engines having eccentric main bearing supports is prevented by supporting the bearings in a crankshaft cradle (16) having a high stiffness and a high natural frequency. The crankshaft cradle (16) is rotatable mounted in the engine on a first axis, and the crankshaft (8) is mounted in the crankshaft cradle (16) on a second axis off-set from the first axis, the first axis and the second axis defining a first plane. The crankshaft cradle comprises a primary eccentric member (24) and a plurality of smaller bearing caps (26) separated by a parting line. The crankshaft cradle comprises accentric members (24) that support the bearing element (64), and structural webbing (72) that rigidly holds the eccentric members (24) in alignment with one another at all times.

23 Claims, 4 Drawing Sheets

OTHER PUBLICATIONS

CA 0920458 A (Heron) Feb. 6, 1973, Fig. 1.
U.S. 6,260,532 B1 (Mendler) Jul. 17, 2001, All.
WO 99/61799 (Mendler) Dec. 2, 1999, All.
Doglas et al., An Experimental Single Cylinder ECCLINK VCR Engline, SAE paper No. 921695, pub 1992.
Larson, "Research Engine for Evaluating the Effects of Variable Compression Ratio . . . " SAE paper No. 910053, pub. 1991.
Wirbeleit et al., "Development of Pistons with Variable Compression Height . . . " SAE paper No. 900229, pub. 1990.
Wallace et al., "A Variable Compression Ratio Engine Development" SAE paper No. 762A, pub. Oct. 1963.
U.S. 3,457,804 A (Harkness) Jul. 29, 1969, Fig. 6.
U.S. 4,656,981 A (Murata et al) Apr. 14, 1987, Figs 1–2.
U.S. 2,433,639 A (Woodruff et al) Dec. 30, 1947, Figs. 1–2.
U.S. 2,589,958 A (Petit) Mar. 18, 1952, Fig. 1.
U.S. 5,715,784 A (Okui et al) Feb. 10, 1998, Fig. 2.
U.S. 5,184,582 A (Okui et al) Feb. 9, 1993, Fig. 4.
U.S. 4,750,455 A (Ebesu) Jun. 14, 1988, Fig. 2.

RIGID CRANKSHAFT CRADLE AND ACTUATOR

PROVISIONAL APPLICATION REFERENCE

This application relates to U.S. Provisional Application No. 60/164,774, having a filing date of Nov. 12, 1999.

BACKGROUND OF THE INVENTION

The present invention relates to a method and apparatus for adjusting the compression ratio of internal combustion engines, and more specifically to a method and apparatus for adjusting the position of the crankshaft with eccentric crankshaft main bearing supports.

Designs for engines having eccentric crankshaft main bearing supports have been known for some time. In these engines the eccentric main bearings are rotated to adjust the axis of rotation of the crankshaft. Significant forces bear down on the eccentric main bearing supports during operation of the engine, causing the eccentric main bearing supports to twist out of alignment. Poor alignment of the eccentric main bearing supports is a problem for these engines because even small amounts of main bearing misalignment can cause rapid main bearing failure. Another problem with engines having eccentric main bearing supports is that of a low natural frequency of vibration. Operation of these engines at or near the natural frequency of the eccentric main bearing supports can destroy the engine. The low natural frequency of these engines is a problem because the engines cannot be operated at speeds necessary for use of the engine in passenger cars, trucks, and other applications.

Engines having only one cylinder and two main bearings can tolerate much greater twisting of the main bearing supports, because the crankshaft is free to self align within the two bearings. Single cylinder engines, however, are not employed in the major automobile markets. An objective of the present invention is to provide an eccentric main bearing support for engines having more than one cylinder that provides a long main bearing life, a high natural frequency, and a low manufacturing cost. Another objective of the present invention is to provide an eccentric main bearing support that does not significantly alter overall engine size and mass. Further objectives of the present invention are to provide a compact eccentric main bearing support that permits balancing of primary cranktrain forces and use of a conventional connecting rod having a length no more than two and one quarter times the stroke of the engine.

European patent EP 345-366-A issued to Buffoli Dec. 13, 1989 shows a variable compression ratio engine having a lower main bearing support 30 and an upper main bearing support 41 fastened together with screws 49. The force applied to the main bearing supports causing them to twist is proportional to the cross sectional area of the power cylinder bore and the power cylinder pressure. Main bearing support 30 includes five lower hemispherical disc segments joined by lower webbing. FIG. 1 of EP 345-366-A shows the webbing to have a small cross sectional area relative to the cross sectional area of the power cylinder bore. FIG. 1 also shows that the cross sectional area of the lower webbing is about 3.8% of the projected area of the eccentric member assembly, where the area of the eccentric member is projected on a plane perpendicular to the axis of rotation of the crankshaft. The lower webbing also has a short length, and spans a small arcuate length about the pivot axis of the main bearing support, about 63 degrees. The webbing with its small area and short length fails to provide rigid support of the main bearings. Furthermore, the part has a low natural frequency due to its lack of rigidity. The length and area of the webbing can only be extended downward a small amount without causing mechanical interference with the connecting rod.

Similarly, main bearing support 41 includes five upper hemispherical disc segments joined by upper webbing. FIG. 1 also shows the upper webbing to have a small cross sectional area relative to the size of the cross sectional area of the power cylinder bore. The upper webbing has a short length, and spans a small arcuate length about the pivot axis of the main bearing support. The length and area of the upper webbing cannot be significantly increased upward without causing mechanical interference with the connecting rod. The small cross sectional area of the upper and lower webbing and the small arcuate length of the upper and lower webbing is incapable of maintaining precise alignment of the main bearings, and consequently the main bearings of the engine shown in EP 345-366-A would fail. Furthermore, the main bearing supports have a natural frequency too low for the engine to be commercially viable. The natural frequency is exceptionally low because the webbing shown does not provide a rigid structure and the eccentric discs are massive relative to the size of the webbing. Additionally, because the upper and lower bearing main supports are tightly fastened together with screws, the mass of the upper bearing support is likely to even further lower the natural frequency of the lower main bearing support, and the mass of the lower bearing support is likely to even further lower the natural frequency of the upper bearing support. The outer diameter of the main bearing supports could be increased and the webbing made thicker to increase rigidity, however, the increased mass of the disc segments would adversely effect the natural frequency of the main bearing segments.

Accordingly, and objective of the present invention is to provide, in multi-cylinder engines having eccentricly supported crankshaft main bearings, rigid support and rigid alignment of the crankshaft main bearings at all times to provide a long main bearing life. A further objective of the present invention is to provide a high natural frequency for the eccentric supports to permit operation of the engine over the range of speeds required for commercial use of the engine.

SUMMARY OF THE INVENTION

In the present invention, a crankshaft cradle, made up of a large primary eccentric member and small main bearing caps, is employed to rigidly hold the crankshaft main bearings in alignment. The parting line between the primary eccentric member and the main bearing caps is oriented approximately vertically, or approximately parallel with the power cylinder line of action. Additionally, the bearing cap fasteners are located horizontally above (closer to the piston) and below the crankshaft, and the bearing cap bridge thickness minimized in order to locate the crankshaft main bearings in close proximity to the crankshaft cradle outer diameter. According to the present invention, the primary eccentric member is made up of eccentric disc segments rigidly joined by webbing, the arcuate span of the webbing about the eccentric disc segments being greater than 120 degrees, and preferably greater than 150 degrees. The large arcuate span of the webbing is made possible by the large size of the primary eccentric member relative to the main bearing caps, by the vertical orientation of the parting line, and by placement of the crankshaft main bearings in close proximity to the crankshaft cradle outer diameter. According to the preferred embodiment of the present invention, the cross sectional area of the webbing within the 120 degree arcuate span is greater than 35 percent of the cross sectional area of the cradle within the same 120 degree arcuate span. Concurrently the diameter of the primary eccentric member is preferably less than 2.5 times the diameter of the power cylinder and less than 4 times the working diameter of the crankshaft main bearing to provide a high natural frequency. Preferably, at mid span between the eccentric discs the cross sectional area of the webbing is greater than 40 percent of the cross sectional area of the power cylinder. The large contiguous area of the webbing provides a high rigidity and a high stiffness for the primary eccentric member, and precise alignment of the main bearings at all times, which in turn provides a long bearing life, and the small diameter of the eccentric discs provides a light weight and a high natural frequency, permitting operation of the engine over the full speed range required for commercial use of the engine.

The webbing is deeply scalloped towards the eccentric discs to provide further support, to further minimize twisting of the primary eccentric member under firing engine loads and to further increase the natural frequency of the crankshaft cradle. Preferably at one forth span between the eccentric disc segments the cross sectional area of the webbing is at least 20 percent greater than the cross sectional area of the webbing at mid span between the eccentric discs. Preferably the primary eccentric member is a single cast piece, and the webbing is contiguous and has no large holes. Additionally, in the preferred embodiment of the present invention the overall mass of the bearing caps is less than 25 percent of the mass of the primary eccentric member, and consequently the bearing caps cause only a small reduction in natural frequency. According to the preferred embodiment of the present invention, the crankshaft cradle has a natural frequency greater than 100 Hz.

DETAILED DESCRIPTION OF THE PREFERRED EMBODIMENTS

Figure 1:
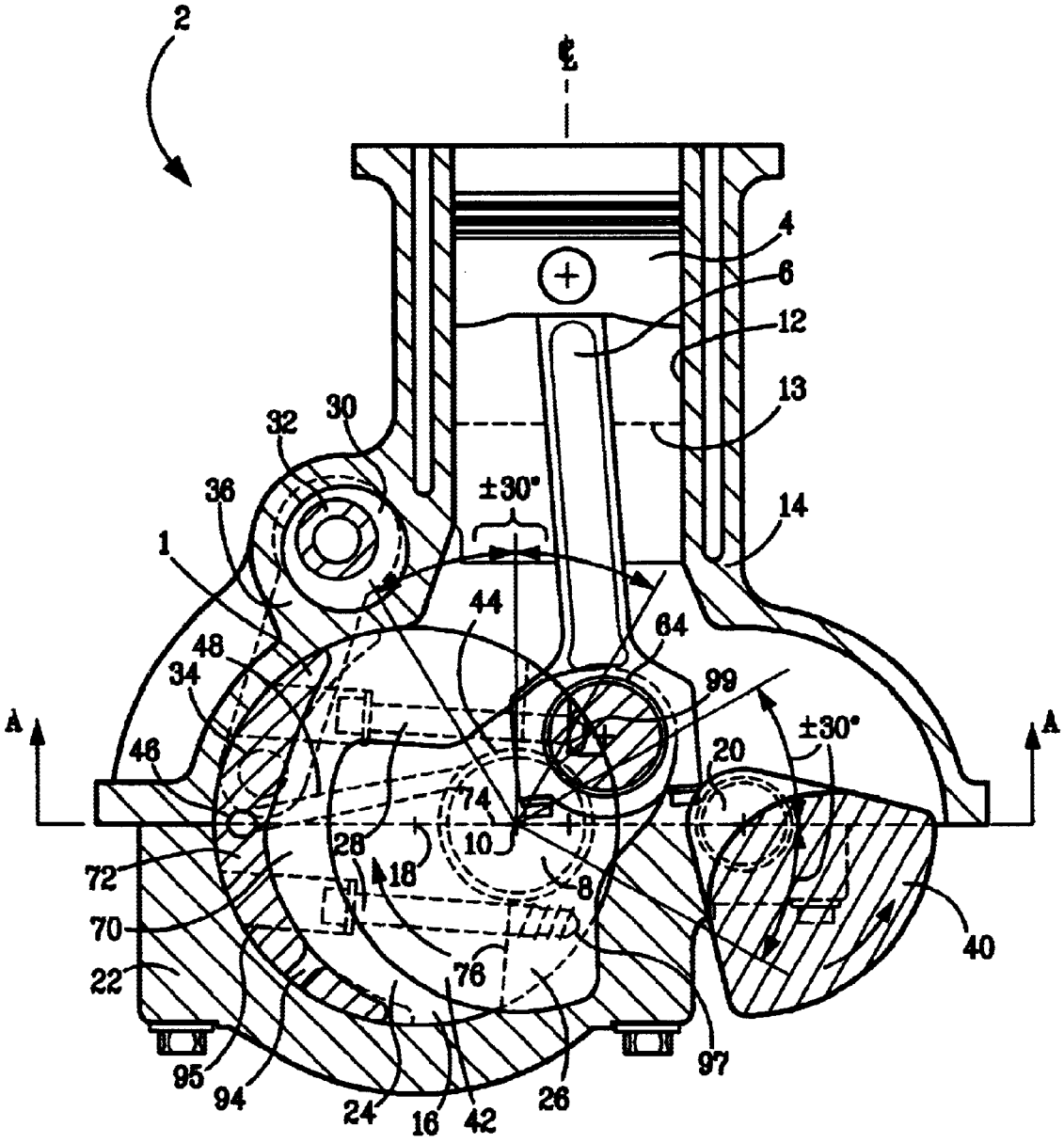
FIG. 1 shows a sectional elevation view of the variable compression ratio mechanism according to the present invention taken along cut lines B—B shown in FIG. 2.

FIG. 1 shows a portion of a variable compression ratio mechanism 1 in a variable compression ratio engine 2 according to the present invention. Engine 2 has a piston 4, a connecting rod 6, a crankshaft 8 having an axis of rotation 10, a power cylinder 12 having a cross sectional area 13 in an engine block 14, a crankshaft cradle 16 having a pivot axis 18, an optional power take-off shaft or balance shaft 20, and an optional bedplate or cradle bearing cap 22. Connecting rod 6 connects piston 4 to crankshaft 8 for reciprocating motion of piston 4 in cylinder 12. Cradle 16 includes a primary eccentric member 24 and a plurality of main bearing caps 26 and a plurality of fasteners 28 for removably fastening bearing caps 26 to primary eccentric member 24 for rotatably supporting crankshaft 8 in crankshaft cradle 16. Engine 2 further includes a control shaft 30 mounted in engine block 14 having one or more off-set journals 32, one or more one or more control pins 34 mounted in cradle 16 and one or more control arms 36 connecting control shaft 30 and control pin 34, control arm 36 being rotatably mounted on off-set journal 32. Rotation of control shaft 30 pivots off-set journal 32 causing control arm 36 to move causing cradle 16 to pivot about pivot axis 18 causing crankshaft axis of rotation 10 to move causing the compression ratio of engine 2 to change.

Figure 2:
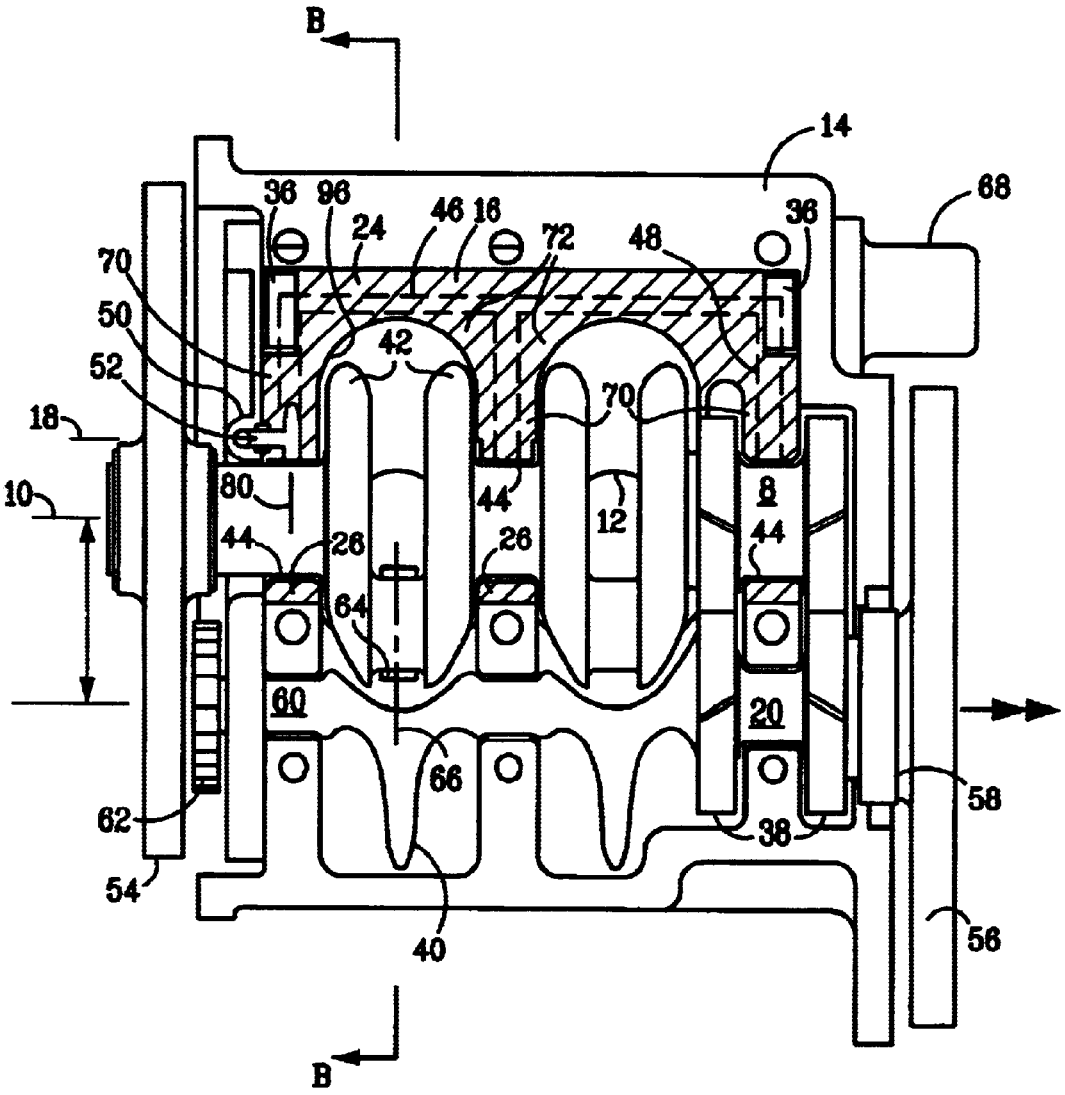
FIG. 2 shows a bottom view of the variable compression ratio engine according to the present invention along cut lines A—A shown in FIG. 1, with the connecting rod and pistons removed to show the crankshaft.

FIG. 2 shows a bottom view of engine 2 according to the present invention along cut lines A—A shown in FIG. 1, with pistons 4 and connecting rods 6 removed to show crankshaft 8. In the embodiment shown, crankshaft 8 and balance shaft 20 include gears 38. In the preferred embodiment of the present invention gears 38 transfer power from crankshaft 8 to power take-off shaft 20, and power take-off shaft 20 transfers power out of engine 2. Gears 38 may have helical teeth or straight cut teeth, and gears 38 may include a single helical gear pair or a double helical gear pair (shown) for neutralizing axial thrust loads caused by the helix angle of the gear teeth. Power take-off shaft 20 may include balance webs 40 for balancing primary (shown) or secondary engine forces. Crankshaft 8 includes crank balance webs 42.

Crankshaft 8 is preferably mounted in journal main bearings 44. Oil is fed to journal bearings 44 through an oil galley 46 and oil feeds 48 located in cradle 16. Preferably, oil is fed to oil galley 46 in cradle 16 through oil fitting 50, oil fitting 50 preferably being located on pivot axis 18. Oil fitting 50 includes an oil feed line 52 in fluid communication with oil galley 46, oil feeds 48 and journal bearings 44. Preferably oil feeds 48 are located between fasteners 28 to provide a rigid mid section of primary eccentric member 24.

Crankshaft 8 may include a first flywheel 54, and power take-off shaft 20 may include a second flywheel 56 having a rotational direction opposite that of the first flywheel 54 to provide reduced engine vibration according to the principles disclosed in U.S. Pat. No. 3,402,707 issued to Paul Heron on Sep. 24, 1968. In the preferred embodiment of the present invention, power take-off shaft 20 includes a first end 58 located in close proximity to gears 38, and a second end 60, where power take-off from the engine 2 is through first end 58 of power take-off shaft 20, thereby providing low torsional loads through the length of power take-off shaft 20, and a larger direct force and a smaller alternating force on gears 38. Second flywheel 56 is located on the first end 58 of power take-off shaft 20, and first flywheel 54 is located on the far end of crankshaft 8. Flywheel 56 may span across crankshaft rotational axis 10 (shown), and flywheel 54 may span across the rotational axis of power take-off shaft 20 (shown) to provide a minimum spacing between crankshaft 8 and power take-off shaft 20, in order to provide optimum engine balancing and a small engine size. A valve gear sprocket or chain 62 (shown), belt, gear or other type of drive is preferably located on the second end 60 of power take-off shaft 20 for driving the valvetrain and/or other engine accessories, it being understood that more than one drive may be located on power take-off shaft 20. Preferably chain 62 is located adjacent to flywheel 54, and between flywheel 54 and flywheel 56, to provide a compact engine size.

Figure 3:
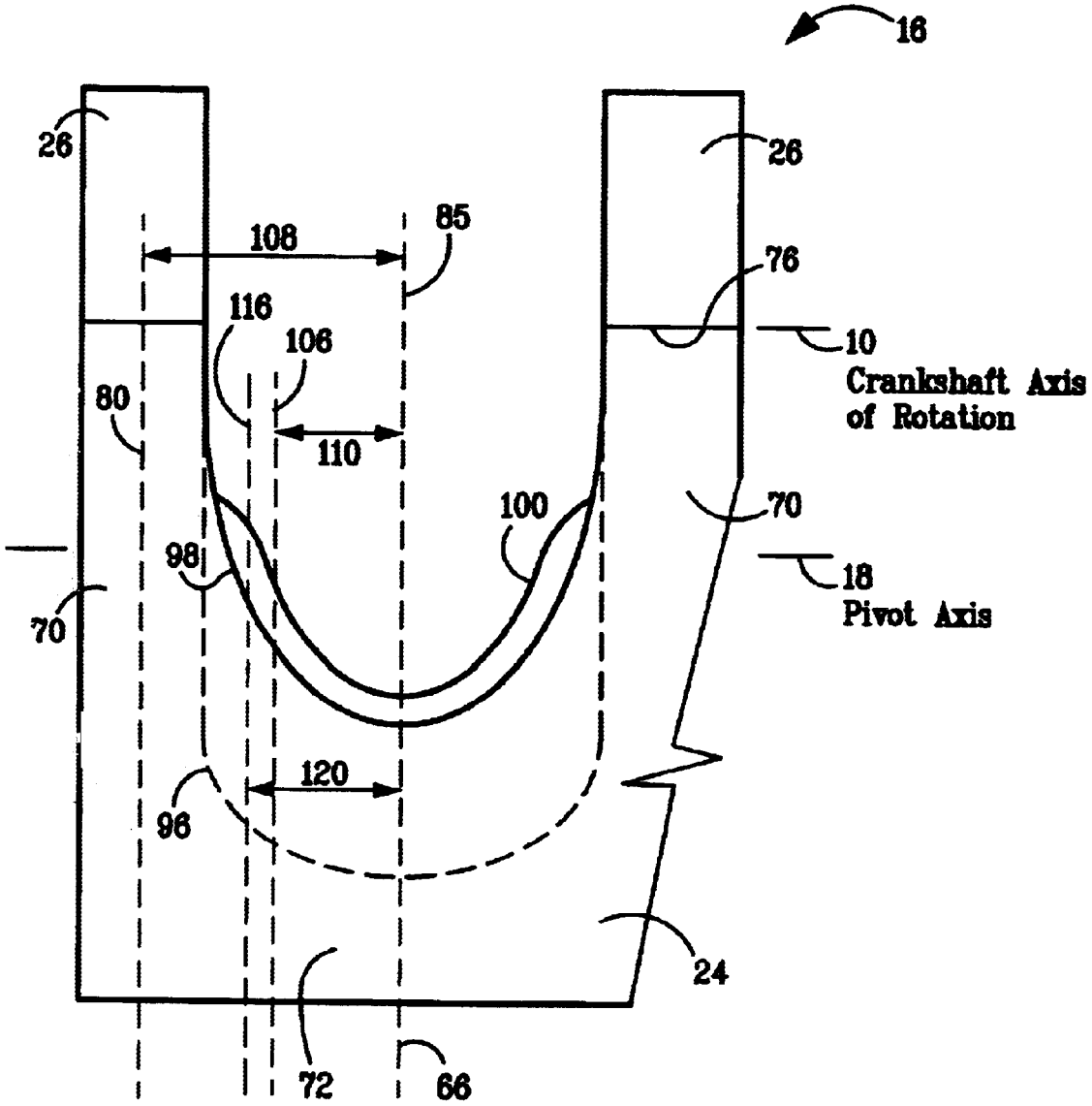
FIG. 3 shows a top view of a portion of the crankshaft cradle shown in FIGS. 1 and 2.

Referring now to all of the figures, according to the preferred embodiment of the present invention engine 2 has a variable compression ratio mechanism 1, a plurality of cylinders 12, it being understood that engine 2 may alternatively have only one cylinder, a piston 4 mounted for reciprocating movement in each of cylinders 12, crankshaft 8 has an axis of rotation 10, and connecting rod 6 connects each piston 4 to crankshaft 8. Referring now to FIGS. 1, 2, and 3, connecting rod 6 has a connecting rod crankshaft bearing 64 having a mid span 66, mid span 66 being shown in FIGS. 2 and 3. Cradle 16 supports crankshaft 8 for rotation of crankshaft 8 about axis of rotation 10, and cradle 16 is mounted in engine 2 for pivoting relative to engine 2 about pivot axis 18, pivot axis 18 being substantially parallel to and spaced from crankshaft rotational axis 10. An actuator 68 (shown in FIG. 2) is mounted on one end of control shaft 30 for varying the position of cradle 16 about pivot axis 18 for varying the position of crankshaft axis of rotation 10, it being understood that a rotary actuator (shown), a hydraulic cylinder type actuator, or another functional type of actuator may be employed to adjust the rotational position of cradle 16 about pivot axis 18. Cradle 16 includes primary eccentric member 24 and a plurality of bearing caps 26 and a plurality of bearing cap fasteners 28 for removably fastening each bearing cap 26 to primary eccentric member 24. According to the present invention, primary eccentric member 24 comprises a plurality of disc segments 70 and webbing 72, disc segments 70 being rigidly jointed together by webbing 72. Preferably, primary eccentric member 24 comprising eccentric discs 70 and webbing 72 is a single cast piece. Crankshaft axis of rotation 10 and pivot axis 18 define a first plane 74, and each bearing cap 26 has a primary contact surface 76 for contact with primary eccentric member 24, primary contact surface 76 being within ±30 degrees of perpendicular to first plane 74, and fasteners 28 are within ±30 degrees of parallel to first plane 74 for providing space on the far side of the cradle from bearing caps 26 for a large and contiguous webbing 72. Primary contact surface 76 is generally perpendicular to the clamping force line of action of fasteners 28, and may be a single flat surface (shown), a serrated or fractured surface where the surface texture of the serration or fracture provides alignment and prevents slip between the bearing caps 26 and primary eccentric member 24, and in such cases primary contact surface 76 may be approximated as a generally flat surface where the minor surface irregularities are ignored. Dowels, stepped joints, fitted bolts, and other functional means may be employed to prevent slip between primary eccentric member 24 and bearing caps 26 such as configurations shown in Bearings, a Tribology Handbook, Edited by M. J. Neale, Reed Educational and Professional Publishing Ltd., 1998, page 61. Crankshaft 8 is mounted in main bearings 44, main bearings 44 have a working diameter 78 (shown in FIG. 4) and a main bearing mid span 80 (shown in FIGS. 2 and 3), and bearing caps 26 have a bridge thickness 82, the bridge thickness 82 of at least one bearing cap being less than 70 percent of the thickness of at least one crankshaft bearing working diameter 78, and preferably less than half the thickness of at least one crankshaft bearing working diameter 78, for location of crankshaft 8 adjacent to the outer diameter of the cradle for providing space for a large web on the far side of the cradle from the bearing caps. Main bearing mid span 80 is located at the center of the radial load bearing portion of the bearing along the axial length of the bearing. Bridge thickness 82 is measured with main bearing 44 removed, and is the shortest distance measured on first plane 74 across bearing cap 26. For engines with a variable bridge thickness as measured at various axial locations of main bearing 44, bridge thickness 82 is the average bridge thickness being in radial load bearing contact with main bearing 44.

Each bearing cap 26 has an upper contact face length or upper centering distance 75 and a lower contact face length or lower centering distance 77 (shown in FIG. 4), each centering distance spanning from main bearing 44 to cradle bearings 122 along the plane of primary contact surface 76. Pivot axis 18 and bearing working diameter (e.g., the crankshaft bearing surface) 78 may be separated by a fitting distance 79 to provide access for oil feed line 52. Preferably, the lower centering distance 77 is at least 1.5 times longer than fitting distance 79. Preferably lower centering distance 77 is at least twice as long as bridge thickness 82 to position the crankshaft near the outer diameter of the crankshaft cradle.

Webbing 72 has a first thick section 84 (shown in FIG. 4) located within a 120 degree arcuate span 88 about pivot axis 18 and located on a second plane 85 perpendicular to pivot axis 18, perpendicular to first plane 74 and passing through the mid span 66 of connecting rod crankshaft bearing 64, first thick section 84 having an outer perimeter 86. First thick section 84 is preferably a single cast piece. The arcuate span of webbing 72 being greater than 120 degrees about the pivot axis in the preferred embodiment of the present invention, and preferably greater than 150 degrees. 120 degree arcuate span 88 has an arcuate area 90 located within outer perimeter 86 and within 120 degree arcuate span 88. First thick section 84 has a first thick section cross sectional area 92, the cross sectional area of first thick section 92 being greater than 25 percent of arcuate area 90, and preferably greater than 35 percent of arcuate area 90, in order to provide crankshaft cradle 16 with a high stiffness and a high natural frequency of vibration. For engines according to the present invention having webbing 72 that spans more than 120 degrees about pivot axis 18, 120 degree arcuate span 88 falls within the arcuate span of webbing 72. For engines according to the present invention having webbing 72 that spans less than 120 degrees about pivot axis 18, 120 degree arcuate span 88 is centered about webbing 72. Preferably webbing 72 has an arcuate span about pivot axis 18 of at least 120 degrees on second plane 85 and perpendicular to first plane 74, for providing a rigid cradle having a high natural frequency.

Preferably, primary eccentric member 24 has a first overall mass, and the removable bearing caps 26 have a second overall mass, the second overall mass being less than 25 percent of the first overall mass, in order to provide a high natural frequency. According to the preferred embodiment of the present invention, cradle 16 has a natural frequency greater than 100 hertz, however, cradle 16 may have a lower natural frequency in some embodiments of the present invention.

Figure 4:
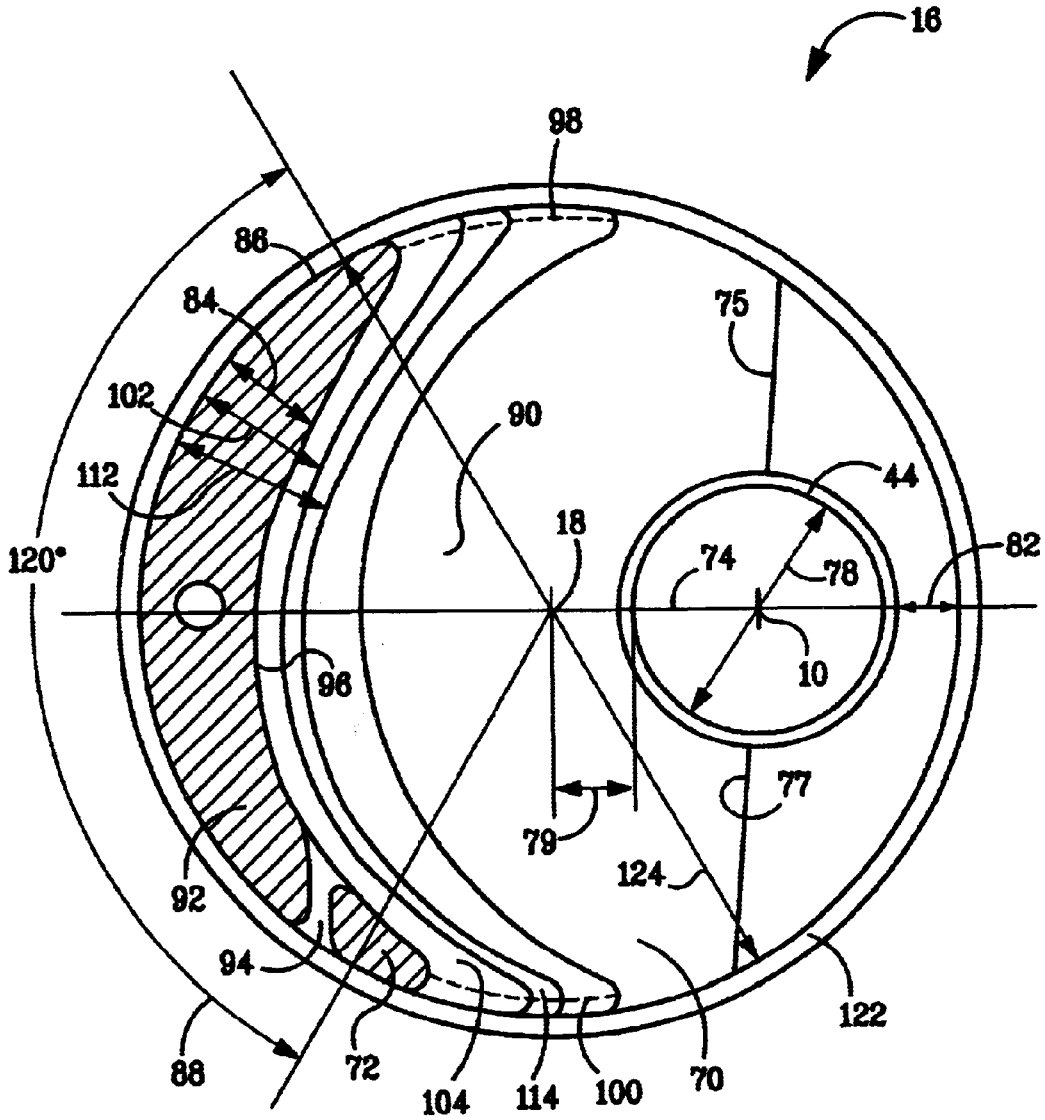
FIG. 4 shows the cross sectional webbing area of the crankshaft cradle shown in FIGS. 1, 2 and 3.

Referring to FIGS. 1 and 4, webbing 72 may include one or more holes 94 for reducing the weight of cradle 16 or for draining engine oil away from the spinning crankshaft or for another purpose. Preferably webbing 72 has no single hole 94 spanning more than 60 degrees within said 120 degree arcuate span 88. Webbing 72 further comprises holes 95 in primary eccentric member 24 for fasteners 28, where between adjacent discs segments 70 webbing 72 is located on both sides of each hole 95 for providing additional structure (e.g., webbing is located above and below each hole 95 as shown in FIG. 1). Preferably main bearing cap 26 includes tapped holes 97 for retaining fasteners 28, and fasteners 28 are screws having an accessible head in primary eccentric member 24 for assembly, in order to provide a bearing cap having a maximum thickness and a maximum strength and stiffness. Alternatively, fasteners 28 may be bolts having an approximately oval head 99, oval heads 99 being seated in main bearing cap 26.

Referring now to FIGS. 2, 3, and 4, webbing 72 includes scalloping 96 between eccentric discs 70 for increasing the rigidity and the natural frequency of primary eccentric member 24. FIG. 2 shows a sectional view of scalloping 96 on first plane 74. The profile of scalloping 96 is indicated by a dashed line in FIG. 3. FIG. 3 shows a top view of a portion of the cradle 16 shown in FIG. 2, and FIG. 2 shows a bottom sectional view of cradle 16. Referring to FIG. 3, line 98 is intended to indicate the profile of scalloping at the top of eccentric member 24 closest to piston 4. Scalloping profile 98 is indicated by a dashed line in FIG. 4. Similarly, line 100 in FIG. 3 is intended to indicate the profile of scalloping at the bottom of eccentric member 24. Scalloping profile 100 is indicated by a dashed line in FIG. 4. Referring now to FIGS. 3 and 4, due to scalloping, the sectional area of webbing 72 is greater near eccentric discs 70, and smaller towards mid span 66. According to the present invention, scalloping increases the rigidity and increases the natural frequency of primary eccentric member 24 and cradle 16. As previously described, webbing 72 has a first thick section 84 having a first thick section cross sectional area 92 located on a second plane 85. Primary eccentric member 24 has a second thick section 102 having a second thick section cross sectional area 104 located on a third plane 106 located parallel to second plane 85, perpendicular to pivot axis 18 and perpendicular to first plane 74 and located within arcuate span 88. Second plane 85 and main bearing mid span 80 being separated by a first distance 108, second plane 85 and third plain 106 being separated by a second distance 110, second distance 110 being half as long as first distance 108. Preferably, according to the present invention, second thick section cross sectional area 104 is at least 10 percent greater than first thick section cross sectional area 92 for providing a rigid cradle 16 and a high natural frequency.

Primary eccentric member 24 has a third thick section 112 having a third thick section cross sectional area 114 located on a forth plane 116 located parallel to second plane 85, perpendicular to pivot axis 18 and perpendicular to first plane 74, and located within arcuate span 88. Second plane 85 and forth plane 116 being separated by a third distance 120, third distance 120 being 60 percent as long as long as first distance 108. Preferably, according to the present invention, third thick section cross sectional area 114 is at least 15 percent greater than first thick section cross sectional area 92 for providing a rigid cradle 16 and a high natural frequency.

Referring now to FIG. 1, preferably each bearing cap 26 is fastened to primary eccentric member 24 by at least two first fasteners 28, the first fastener and the second fastener being located approximately perpendicular to primary contact surface 76, and the first fastener is located on the far side of crankshaft main bearing 44 from the second fastener.

Referring now to FIG. 4, cradle 16 is supported by one or more cradle bearings 122 having a cradle bearing diameter 124 for pivotally supporting cradle 16 about pivot axis 18. Cradle bearing diameter 124 is preferably no more than 4 times crankshaft bearing working diameter 78 in order to provide a cradle having a low mass, a low polar moment of inertia, and a high natural frequency. Cradle 16 may have cradle bearings diameters 124 of various diameters, and may have crankshaft bearing working diameters 78 of various diameters, in some embodiments of the present inventions. Cradle bearing diameter 124 is the average bearing diameter of the bearings supporting cradle 16, and crankshaft bearing working diameter 78 is the average bearing diameter of the bearings supporting crankshaft 8 in embodiments having dissimilar bearing diameters, where average diameter is determined by weighting the bearings for their axial length (e.g., the sum of each bearing diameter times its load bearing axial length in the numerator, and the sum of the axial load bearing lengths of the bearings in the denominator). Optimally bridge thickness 82 is no more than half the thickness of at least one crankshaft bearing working diameter 78 in order to provide a cradle having a low mass, a low polar moment of inertia, and a high natural frequency.

Accordingly, the present invention provides, in multi-cylinder engines having eccentricly supported crankshaft main bearings, rigid support and rigid alignment of the crankshaft main bearings at all times for provide a long main bearing life. The present invention provides a high natural frequency for the eccentric supports permitting operation of the engine over the range of speeds required for commercial use of the engine. Additionally, the present invention can be manufactured at a low cost. Those skilled in the art will recognize that the invention can be practiced with modifications within the spirit and scope of the claims. For example, the present invention may be employed in compressors, pumps, and expanders, and also in single cylinder as well as multi-cylinder machines.

What is claimed is:

1. A variable compression ratio mechanism for a reciprocating piston machine having one or more cylinders, a piston mounted for reciprocating movement in each of said cylinders, a crankshaft defining an axis about which the crankshaft rotates, and a connecting rod connecting each of said pistons to the crankshaft, said connecting rod having a connecting rod crankshaft bearing having a mid span, comprising;

a crankshaft cradle supporting the crankshaft for rotation of the crankshaft about the rotational axis of the crankshaft, said cradle having an outer cradle bearing diameter for pivotally supporting said cradle in the reciprocating piston machine about a pivot axis, said pivot axis being concentric with said outer cradle bearing diameter, the pivot axis being substantially parallel to and spaced from the rotational axis of the crankshaft, wherein said cradle is mounted in said reciprocating piston machine and motion of said outer cradle bearing diameter is restricted by said reciprocating piston machine to pivoting about said pivot axis, thereby substantially preventing reciprocating motion of said cradle in said reciprocating machine, an actuator for varying the position of the cradle about the pivot axis for varying the position of the rotational axis of the crankshaft, said cradle comprising a primary eccentric member, a plurality of bearing caps, and a plurality of bearing cap fasteners for removably fastening each bearing cap to the primary eccentric member, wherein said primary eccentric member comprises a plurality of disc segments and webbing, said disc segments being rigidly joined together by said webbing, wherein a portion of said webbing and at least two of said disc segments are a single cast piece, said crankshaft axis and said pivot axis defining a first plane, said bearing caps having a primary contact surface for contact with said primary eccentric member, a portion of said primary contact surface being within 40 degrees of perpendicular to said first plane, and at least one of said fasteners being within 40 degrees of parallel to said first plane for providing space on the far side of the cradle for a large and contiguous webbing, said crankshaft having a plurality of main bearings, said main bearings having a working diameter and a main bearing mid span, and said bearing caps having a bridge thickness, said bridge thickness being the distance on said first plane between said outer cradle bearing diameter and said crankshaft main bearing, the bridge thickness of at least one bearing cap being less than 70 percent of the thickness of at least one crankshaft main bearing working diameter, for location of the crankshaft adjacent to the outer diameter of the cradle for providing space for a large web on the far side of the cradle, said reciprocating piston machine having a second plane perpendicular to said pivot axis and perpendicular to said first plane and passing through said connecting rod crankshaft bearing mid span, wherein said cradle has webbing between at least two adjacent eccentric discs, said webbing being located on said second plane over an arc distance about said pivot axis greater than 120 degrees, thereby providing a crankshaft cradle with a high stiffness.

2. The variable compression ratio mechanism of claim 1, wherein the reciprocating piston machine is an engine.

3. The variable compression ratio mechanism of claim 1, wherein the reciprocating piston machine is has two or more cylinders.

4. The variable compression ratio mechanism of claim 1, wherein said webbing has a first thick section located within a 120 degree arcuate span about said pivot axis and located on said second plane, said first thick section having an outer perimeter, said 120 degree arcuate span having an arcuate area located within said outer perimeter and within said 120 degree arcuate span, said first thick section having a first cross sectional area, said first cross sectional area of said first thick section being greater than 25 percent of said arcuate area, thereby providing a rigid cradle having a high natural frequency.

5. The variable compression ratio mechanism of claim 1, wherein the primary eccentric member has a first overall mass, and the removable bearing caps have a second overall mass, the second overall mass being less than 25 percent of the first overall mass, thereby providing a crankshaft cradle with a high natural frequency.

6. The variable compression ratio mechanism of claim 1, wherein the webbing has no single hole spanning more than 60 degrees within said 120 degrees on said second plane.

7. The variable compression ratio mechanism of claim 1, wherein the cradle has a natural frequency greater than 100 hertz.

8. The variable compression ratio mechanism of claim 1, wherein the webbing includes scalloping between at least two adjacent disc segments for increasing the rigidity and the natural frequency of the primary eccentric member.

9. The variable compression ratio mechanism of claim 8, wherein the webbing between said two adjacent disc segments has a second thick section having a second thick section cross sectional area located on a third plane parallel to said second plane and perpendicular to said pivot axis, said second thick section cross sectional area being located within said 120 degrees about said pivot axis, said second plane and said main bearing mid span being separated by a first distance, said second plane and said third plane being separated by a second distance, said second distance being 60 percent as long as said first distance, wherein said second thick section cross sectional area is at least 15 percent greater than said first thick section cross sectional area.

10. The variable compression ratio mechanism of claim 1, wherein each bearing cap is fastened to said primary eccentric member by at least a first fastener and a second fastener, said first fastener and said second fastener being located approximately perpendicular to said portion of said primary contact surface, and said first fastener being located on the far side of said crankshaft main bearing from said second fastener.

11. The variable compression ratio mechanism of claim 1, further comprising cradle bearings for pivotally supporting said cradle about said pivot axis, said cradle bearings having a cradle bearing diameter, said cradle bearing diameter being no more than 4 times said working diameter, thereby providing a cradle having a low mass, a low polar moment of inertia, and a high natural frequency.

12. The variable compression ratio mechanism of claim 1, wherein said bridge thickness is no more than half the thickness of at least one crankshaft bearing working diameter, thereby providing a cradle having a low mass, a low polar moment of inertia, and a high natural frequency.

13. The variable compression ratio mechanism of claim 1, wherein said portion of said primary contact surface is within ±30 degrees of perpendicular to said first plane.

14. The variable compression ratio mechanism of claim 1, wherein the webbing includes holes within said 120 degrees on said second plane.

15. The variable compression ratio mechanism of claim 1, further comprising holes in said primary eccentric member for said fasteners, wherein between adjacent disc segments said webbing is located on both sides of each of said holes for providing additional structure.

16. The variable compression ratio mechanism of claim 1, further comprising tapped holes in said bearing cap, wherein said fasteners are screws having an exposed head in said primary eccentric member for providing a maximum thickness bearing cap having a maximum strength and stiffness.

17. The variable compression ratio mechanism of claim 1, wherein said fasteners are bolts having an oval head, said oval heads being seated in said bearing cap.

18. The variable compression ratio mechanism of claim 4, wherein said first cross sectional area of said first thick section is greater than 35 percent of said arcuate area, thereby providing a crankshaft cradle with a high stiffness and a high natural frequency of vibration.

19. The variable compression ratio mechanism of claim 1, wherein at least one of said bearing caps has a lower centering distance spanning from said working diameter to the outer diameter of said cradle along the plane of said portion of said primary contact surface, said pivot axis and said working diameter being separated by a fitting distance, wherein said lower centering distance is at least 1.5 times as long as said fitting distance for providing space on the far side of the cradle for a large webbing.

20. The variable compression ratio mechanism of claim 1, wherein at least one of said bearing caps has a lower centering distance spanning from said working diameter to the outer diameter of said cradle along the plane of said portion of said primary contact surface, wherein said lower centering distance is at least twice as long as said bridge thickness for providing space on the far side of the cradle for a large webbing.

21. The variable compression ratio mechanism of claim 1, further including a power take off shaft having a first pair of helical gears, said power take off shaft being mounted in said variable compression ratio machine, and said crankshaft having a second pair of helical gears in mesh with said first pair of helical gears for transferring power from said crankshaft to said power take off shaft, said first pair of helical gears having helix angles for neutralizing axial thrust loads on the cradle caused by the helix angle of the gear teeth.

22. A variable compression ratio mechanism for a reciprocating piston machine having one or more cylinders, a piston mounted for reciprocating movement in each of said cylinders, a crankshaft defining an axis about which the crankshaft rotates, and a connecting rod connecting each of said pistons to the crankshaft including;

a crankshaft cradle supporting the crankshaft for rotation of the crankshaft about the rotational axis of the crankshaft, said cradle having an outer cradle bearing diameter for pivotally supporting said cradle in the reciprocating piston machine about a pivot axis, said pivot axis being concentric with said outer cradle bearing diameter, the pivot axis being substantially parallel to and spaced from the rotational axis of the crankshaft, wherein said cradle is mounted in said reciprocating piston machine and motion of said outer cradle bearing diameter is restricted by said reciprocating piston machine to pivoting about said pivot axis, thereby substantially preventing reciprocating motion of said cradle in said reciprocating machine, a cradle pin mounted in said cradle, and an eccentric pin mounted in said reciprocating machine, a link connecting said cradle pin and said eccentric pin, and an actuator for rotating said eccentric pin, wherein rotating said eccentric pin adjusts the position of said link and adjusts the rotational position of the cradle, and adjusts the position of the crankshaft rotational axis, and adjusts the compression ratio of said reciprocating piston machine.

23. The variable compression ratio mechanism of claim 22, wherein said cradle comprises a primary eccentric member, a plurality of bearing caps, and a plurality of bearing cap fasteners for removably fastening each bearing cap to the primary eccentric member, wherein said primary eccentric member comprises a plurality of disc segments and webbing, said disc segments being rigidly joined together by said webbing, and a first and a second fastener passing through at least one of said disc segments for fastening said bearing cap to said disc segment, said first fastener defining a first fastener axis concentric with the shaft of said first fastener, and a second fastener defining a second fastener axis concentric with the shaft of said second fastener, and said cradle pin has a cradle pin axis being concentric with the outer diameter of said cradle pin, wherein said cradle pin axis passes between said first fastener axis and said second fastener axis, for providing a rigid cradle structure.

* * * * *